US006905365B1

(12) United States Patent
Liu

(10) Patent No.: US 6,905,365 B1
(45) Date of Patent: Jun. 14, 2005

(54) COAXIAL CABLE CONNECTOR

(75) Inventor: Kun-Hung Liu, Taipei (TW)

(73) Assignee: Cablenet Co., Ltd., Taipei Hsien (TW)

( * ) Notice: Subject to any disclaimer, the term of this patent is extended or adjusted under 35 U.S.C. 154(b) by 0 days.

(21) Appl. No.: 10/711,801

(22) Filed: Oct. 6, 2004

(30) Foreign Application Priority Data

Jan. 8, 2004 (TW) ..... 093200319

(51) Int. Cl.[7] ..... H01R 9/05
(52) U.S. Cl. ..... 439/578
(58) Field of Search ..... 439/578–585

(56) References Cited

U.S. PATENT DOCUMENTS 5,002,503 A * 3/1991 Campbell et al. ..... 439/578
5,879,191 A * 3/1999 Burris ..... 439/584
6,261,126 B1 * 7/2001 Stirling ..... 439/583
6,716,062 B1 * 4/2004 Palinkas et al. ..... 439/578
6,767,249 B1 * 7/2004 Li ..... 439/579
6,790,083 B1 * 9/2004 Chen ..... 439/583

* cited by examiner

*Primary Examiner*—Michael C. Zarroli

(57) ABSTRACT

A coaxial cable connector is disclosed to include a first connecting member threaded onto a matching coaxial cable connector (jack), a second connecting member sleeved onto a coaxial cable, a locating barrel mounted on the outer end of a tube of conducting material of the coaxial cable that is turned backwards, and a center holding down member mounted inside the first connecting member to separate a central conductor of the coaxial cable from the tube of conducting material and forced by the first connecting member to squeeze the tube of conducting material in a stepped center through hole of the second connecting member.

2 Claims, 6 Drawing Sheets

COAXIAL CABLE CONNECTOR

This application claims the priority benefit of Taiwan patent application number 093200319 filed on Jan. 8, 2004.

BACKGROUND OF THE INVENTION

1. Field of the Invention

The present invention relates to a coaxial cable connector for connecting a coaxial cable to a matching coaxial cable connector (jack) for signal transmission and more particularly, to such a coaxial cable connector that can easily and quickly be assembled and installed with the hands without tools.

2. Description of the Related Art

A regular coaxial cable connector generally comprises a connector body and a thin layer connecting tube. The thin layer connecting tube is fixedly fastened to the coaxial cable by a scrimping tool, for enabling the central conductor of the coaxial cable to be suspended inside the thin layer connecting tube for connection to the tubular center contact of a matching coaxial cable connector. Because the thin layer connecting tube has a longitudinal seam line, the thin layer connecting tube may break easily when the user crimping the thin layer connecting tube to fix the thin layer connecting tube to the coaxial cable. A conventional coaxial cable connector, which comprises a casing, a barrel rotatably coupled to the casing and defining with an extension of the casing, an annular receiving space, and a coupling member coupled to a rear extension of the casing. The coupling member has a tapered axial hole. Squeezing the coupling member causes the rear extension of the casing to compress the coaxial cable, thereby securing the barrel to the coaxial cable. This design of coaxial cable connector is still not satisfactory in function for the disadvantages below.

The coupling member may be forced to displace and to move away from the casing when the coaxial cable is bent or stretched during installation.

Because the coupling member is coupled to the casing and has an outer diameter greater than the casing and the outer diameter of the matching coaxial cable connector, the coupling member is in the way to hinder the connection of the casing to the matching coaxial cable connector.

SUMMARY OF THE INVENTION

The present invention has been accomplished under the circumstances in view. It is therefore the main object of the present invention to provide a coaxial cable connector, which can easily and quickly be assembled with the hands without tools. It is another object of the present invention to provide a coaxial cable connector, which can easily and positively be installed to connect a coaxial cable to a matching coaxial cable connector (jack). To achieve these and other objects of the present invention, the coaxial cable connector comprises a first connecting member threaded onto the matching coaxial cable connector (jack), a second connecting member rotatably coupled to the first connecting member and sleeved onto a coaxial cable, a locating barrel mounted on the coaxial cable inside the second connecting member, and a center holding down member, which separates the central conductor of the coaxial cable from the tube of conducting material and to squeeze the tube of conducting material in a stepped center through hole of the second connecting member upon connection of the first connecting member to the matching coaxial cable connector (jack). Further, the first connecting member has an embossed peripheral wall for positioning of the fingers to thread the first connecting member onto the matching coaxial cable connector (jack).

DETAILED DESCRIPTION OF EMBODIMENT

Figure 1:
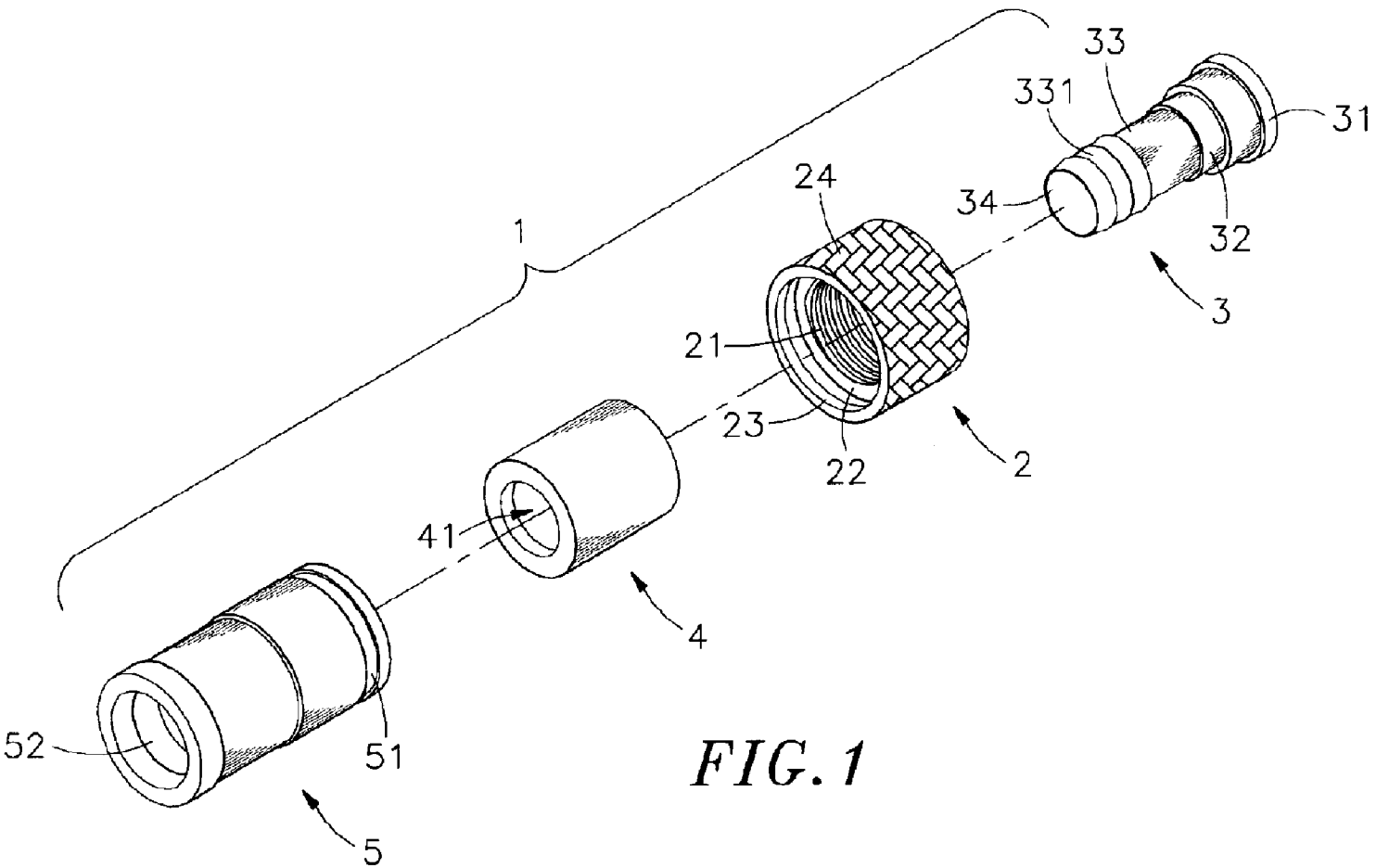
FIG. 1 is an exploded view of a coaxial cable connector according to the present invention.
Figure 2:
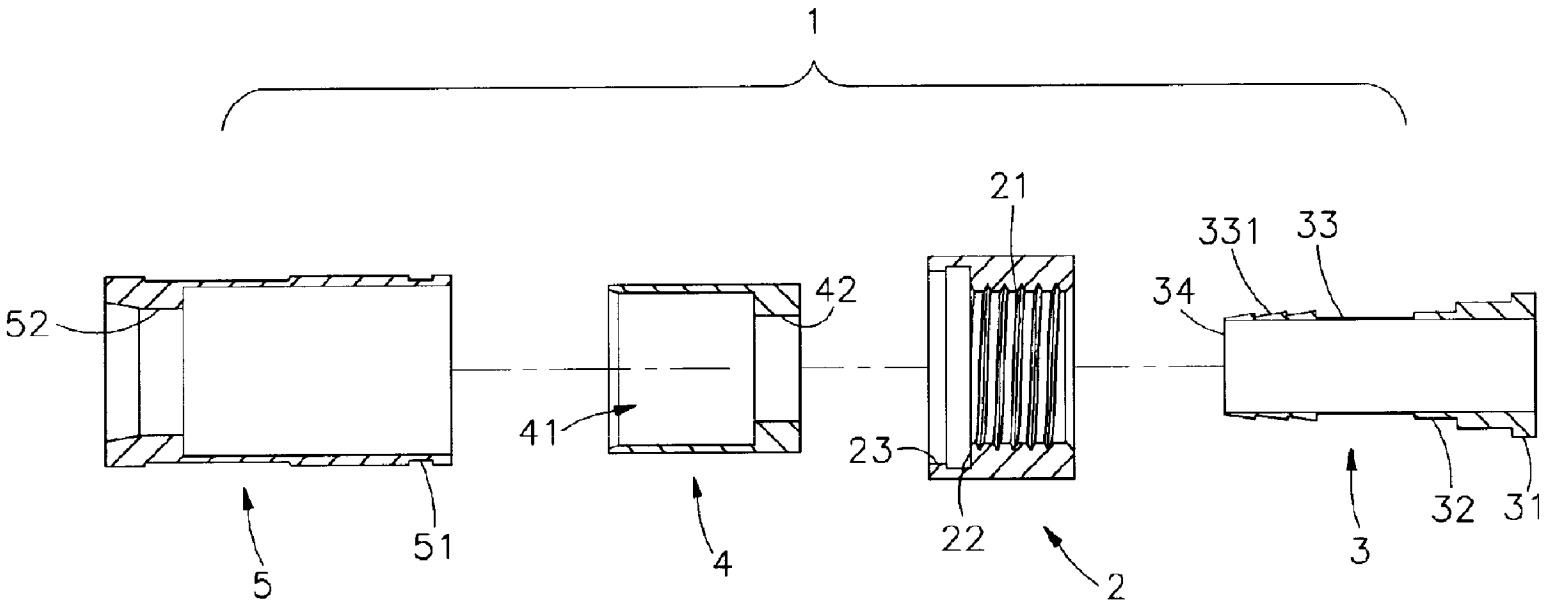
FIG. 2 is a sectional side view of FIG. 1.
Figure 3:
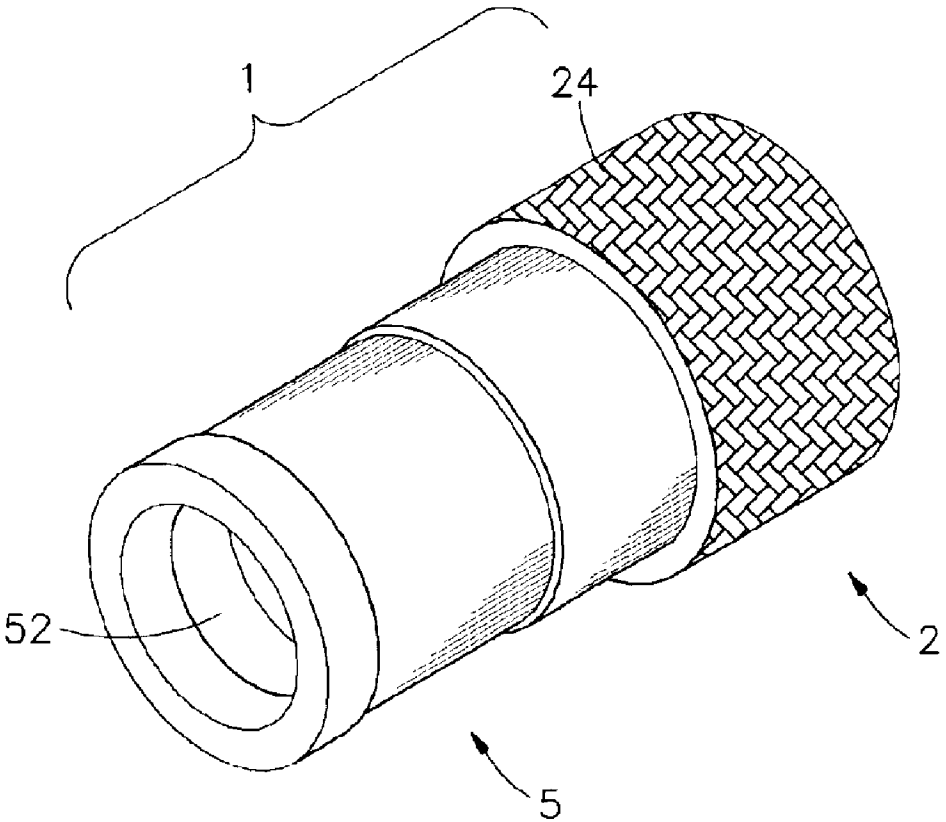
FIG. 3 is an elevational assembly view of the coaxial cable connector according to the present invention.
Figure 4:
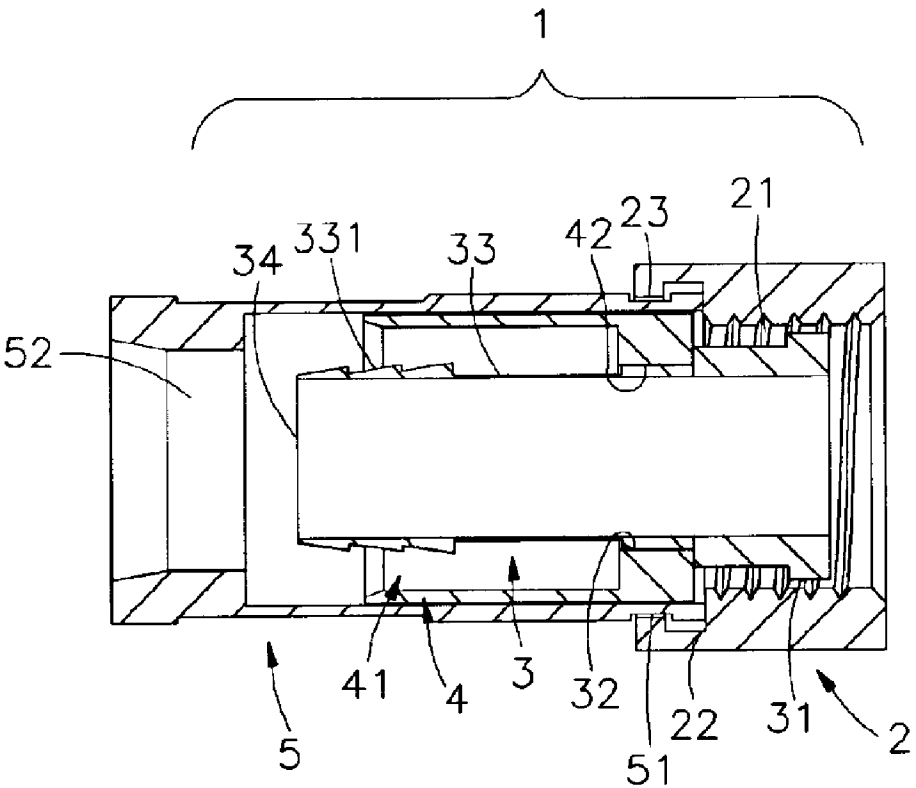
FIG. 4 is a sectional side view of FIG. 3.

Referring to FIGS. 1–4, a coaxial cable connector 1 in accordance with the present invention is shown comprising a first connecting member 2, a center holding down member 3, a locating barrel 4, and a second connecting member 5.

The first connecting member 2 is connectable to a matching coaxial cable connector (jack) at an electronic apparatus, having an inner thread 21 spirally extended around the inside wall at one end, an annular inside coupling flange 23 extended around the inside wall at the other end, an inside annular step 22 extended around the inside wall between the inner thread 21 and the annular inside coupling flange 23, and an embossed peripheral wall 24.

The center holding down member 3 is a hollow cylindrical member inserted into the first connecting member 2, having a center through hole 34 axially extended through the front and rear ends thereof, a rear stop flange 31 extended around the periphery at the rear end, a plurality of hooked portions 331 extended around the periphery at the front end and arranged in parallel, a smooth body portion 33 connected between the hooked portions 331 and the rear stop flange 31, and a coupling portion 32 connected between the smooth body portion 33 and the rear stop flange 31.

The locating barrel 4 has a receiving through hole 41 adapted to receive the center holding down member 3, and an inside annular flange 42 for press-fitting onto the coupling portion 32 of the center holding down member 3.

The second connecting member 5 is a tubular member sleeved onto the locating barrel 4 against the inside annular step 22 of the first connecting member 2 to a coaxial cable, having an outside annular coupling groove 51 extended around the periphery near one end and coupled to the annular inside coupling flange 23 of the first connecting member 2 and a stepped center through hole 52 with smaller diameter extended around other end away from the outside annular coupling groove 51.

The assembly process of the coaxial cable connector 1 is outlined hereinafter with reference to FIGS. 1 and 4 again. The center holding down member 3 is inserted into the first connecting member 2, keeping the coupling portion 32, smooth body portion 33 and hooked portions 331 of the center holding down member 3 exposed to the outside of the first connecting member 2, and then the locating barrel 4 is sleeved onto the center holding down member 3 to press-fit the inner annular flange 42 onto the coupling portion 32 of the center holding down member 3, and at final the second connecting member 5 sleeved onto the locating barrel 4 is inserted with force into the inside of the first connecting member 2 and stopped against the inside annular step 22 of the first connecting member 2 to couple the outside annular coupling groove 51 to the annular inside coupling flange 23 of the first connecting member 2. When assembled, the first connecting member 2 can freely be rotated relative to the second connecting member 5.

Figure 5:
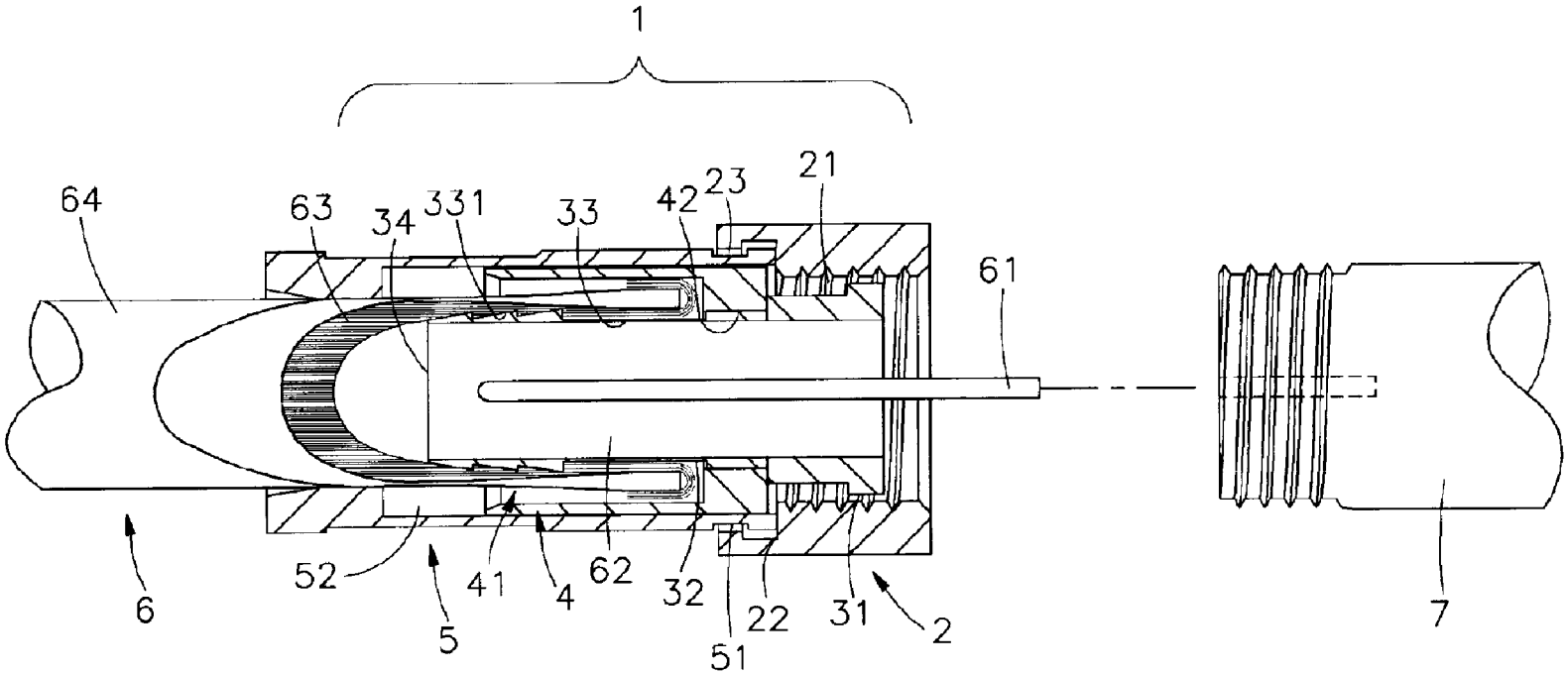
FIG. 5 is a sectional view showing the coaxial cable connector fastened to a coaxial cable according to the present invention.
Figure 6:
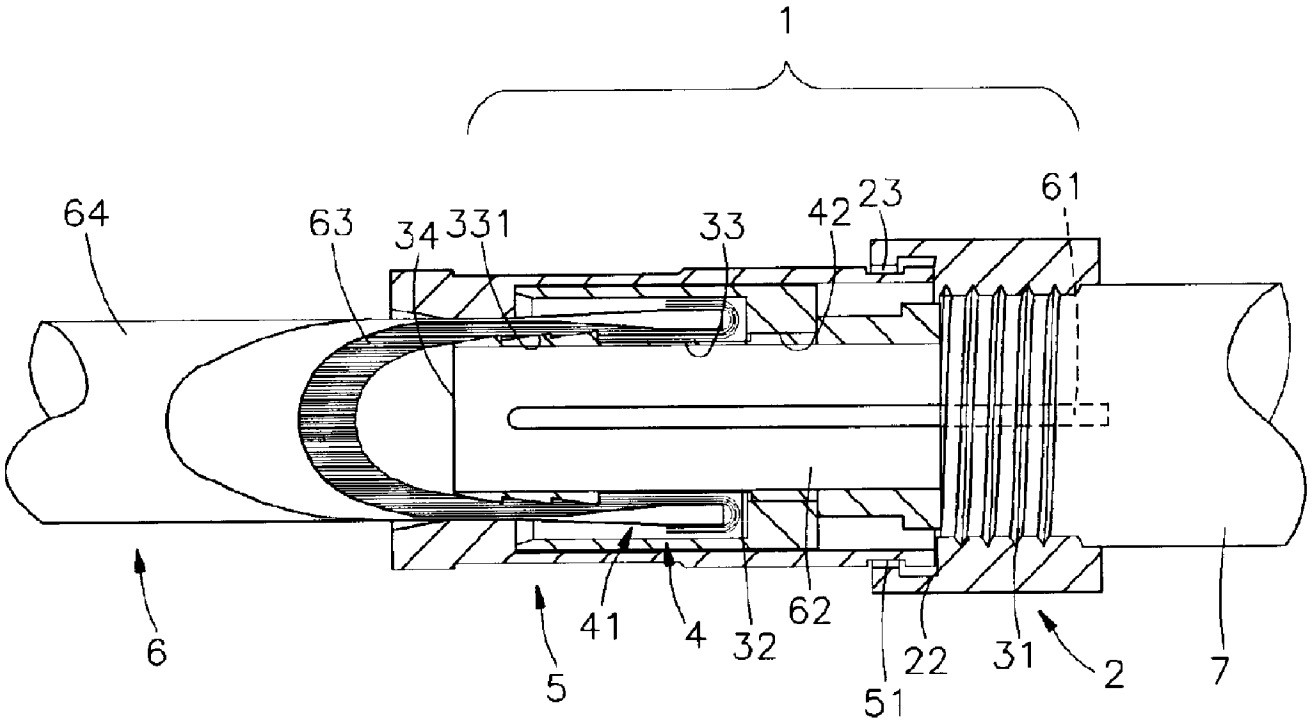
FIG. 6 corresponds to FIG. 5, showing the first connecting member fastened to the matching coaxial cable connector (jack).

Referring to FIGS. 5 and 6, the coaxial cable connector 1 connects a coaxial cable 6 to a matching coaxial cable connector (jack) 7 at an electronic apparatus (not shown). The coaxial cable 6 comprises a central conductor 61, a tube of conducting material 63 surrounding the central conductor 61, an inner insulative layer 62 holding the central conductor 61 within the tube of conducting material 63 and isolating the tube of conducting material 63 from the central conductor 61, and an outer insulative layer 64 covering the tube of conducting material 63. The coaxial cable 6 is inserted into the stepped center through hole 52 of the second connecting member 5 and the center receiving hole 41 of the locating barrel 4 to press-fit the inner insulative layer 62 into the center through hole 34 of the center holding down member 3, keeping the central conductor 61 suspended outside the first connecting member 2 and the tube of conducting material 63 and outer insulative layer 64 of the coaxial cable 6 covered on the periphery of the center holding down member 3 and the tube of conducting material 63 engaged with the hooked portions 331 of the center holding down member 3. After connection of the coaxial cable connector 1 to the coaxial cable connector (jack) 7, the first connecting member 2 is threaded onto the matching coaxial cable connector (jack) 7. When threading the first connecting member 2 onto the matching coaxial cable connector (jack) 7, the center holding down member 3 is forced to move axially toward the coaxial cable 6 and to squeeze the tube of conducting material 63 into the stepped center through hole 52 of the second connecting member 5, and therefore the coaxial cable 6 is firmly secured to the second connecting member 5 of the coaxial cable connector 1.

Further, because the first connecting member 2 has an outer diameter greater than the second connecting member 5 and has the embossed peripheral wall 24 for positive grasping of the hand, the first connecting member 2 can easily be threaded onto the matching coaxial cable connector (jack) 7.

A prototype of coaxial cable connector has been constructed with the features of FIGS. 1–6. The coaxial cable connector functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A coaxial cable connector comprising a first connecting member connectable to a matching coaxial cable connector (jack), said first connecting member having an inner thread formed in one end thereof for threading onto the matching coaxial cable connector (jack), an annular inside coupling flange formed in an opposite end thereof, and an inside annular step extended around an inside wall thereof between said inner thread and said annular inside coupling flange;

a center holding down member inserted into said first connecting member, said center holding down member having a front end, a rear end, a center through hole axially extended through the front and rear ends, a rear stop flange extended around the periphery at the rear end, a plurality of hooked portions extended around the periphery at the front end and arranged in parallel, a smooth body portion connected between said hooked portions and said rear stop flange, and a coupling portion connected between said smooth body portion and said rear stop flange;

a locating barrel, said locating barrel having a center receiving hole, which receives said center holding down member in position, and an inside annular flange pressed on the coupling portion of said center holding down member; and a second connecting member sleeved onto said locating barrel for connecting said first connecting member to a coaxial cable having a tube of conducting material surrounding a central conductor held in place by a inner insulative layer, said second connecting member having an outside annular coupling groove extended around the periphery near a first end thereof and coupled to the annular inside coupling flange of said first connecting member and a stepped center through hole extended around other end away from said outside annular coupling groove and adapted to receive the coaxial cable for enabling the central conductor of the coaxial cable to be electrically connected to the matching coaxial cable connector (jack) to which said first connecting member is connected and the tube of conducting material to be held in the stepped center through hole of said second connecting member.

2. The coaxial cable connector as claimed in claim 1, wherein said first connecting member has an embossed peripheral wall.

* * * * *